United States Patent [19]

Beaupre

[11] Patent Number: 4,880,345

[45] Date of Patent: Nov. 14, 1989

[54] LOAD HOISTING ASSEMBLY PARTICULARLY FOR BOATS

[76] Inventor: Serge Beaupre, 45 d'Orléans, Ville Lorraine, Quebec, Canada, J6Z 2S6

[21] Appl. No.: 276,399

[22] Filed: Nov. 25, 1988

[51] Int. Cl.[4] ..... B63B 27/18

[52] U.S. Cl. ..... 414/137.9; 414/142.8; 212/190; 114/343; 294/67.33

[58] Field of Search ..... 414/142.8, 137.9, 540, 414/543, 678, 626; 114/343, 368, 369, 364, 374, 365, 268, 210; 212/190, 254, 265; 254/335, 334, 326, 329; 294/119.1, 67.3, 67.33

[56] References Cited

U.S. PATENT DOCUMENTS

| | | | |
|---|---|---|---|
| 2,892,555 | 6/1959 | Hooker | 254/326 X |
| 3,077,613 | 2/1963 | Mayer | 212/254 X |
| 3,943,585 | 3/1976 | Leral | 114/221 R |
| 4,362,119 | 12/1982 | Thimander | 114/364 X |
| 4,526,126 | 7/1985 | Dunn | 114/365 |

FOREIGN PATENT DOCUMENTS

| | | | |
|---|---|---|---|
| 1073 | of 1880 | United Kingdom | 114/368 |

*Primary Examiner*—Robert J. Spar
*Assistant Examiner*—James T. Eller, Jr.
*Attorney, Agent, or Firm*—Bacon & Thomas

[57] ABSTRACT

Disclosed is a load-hoisting assembly for mounting on a pair of horizontal rails spaced apart a predetermined vertical distance. The assembly comprises an upright post having a jib at its upper end provided with a hoisting device. The assembly also comprises an upper rail-engageable member to be secured to the upper one of the rails and a lower rail-engageable member to be secured to the lower rail. A connection structure is provided to join the two rail-engageable members to the post. This connection structure is so constructed as to allow relative displacement of the two members to suit the particular distance between the two rails.

8 Claims, 3 Drawing Sheets

LOAD HOISTING ASSEMBLY PARTICULARLY FOR BOATS

BACKGROUND OF THE INVENTION

1. Field of the Invention

The present invention relates generally to a load-hoisting assembly to be fixed to a pair of rails of the deck railing of a large pleasure boat such as a rail boat. More particularly, the assembly is for hoisting and storing the outboard motor of a dinghy or the like tender, onto the said railing.

2. Description of the Prior Art

It is common practice, in this field of large pleasure boats and especially of sail boats, to haul a dinghy behind the boat for use as a tender when it is desired to go ashore and the boat is anchored or moored off-shore; the dinghy being provided, for that purpose, with a small outboard motor. Before the boat goes on a cruise, the outboard motor is first brought in the ship, for obvious safety reasons. To do so, the dinghy is drawn against the heel of the boat, the motor is unfastened from the dinghy and hand-lifted to be hooked onto a storing bracket secured on the deck railing. A storing bracket of this type is disclosed in U.S. Pat. No. 3,943,585 of Mar. 16, 1976. Reverse operation is carried out when the motor is again brought into and installed on the dingy.

It will be appreciated that, with the necessarily light dinghy not being firmly held against the boat and thus very easily rocked, these operations are not only tiresome but also quite dangerous, particularly if there is only one person to carry them out.

SUMMARY OF THE INVENTION

It is therefore an object of the invention to propose a horsting assembly capable of lifting the outboard motor from the dinghy thereby completely avoiding the hand-carrying dangerous operation referred to above.

Another important object is to provide a hoisting assembly which, according to the invention, can easily be mounted on the railing of the boat regardless of the distance between the horizontal rails, that is to say, the assembly can readily be adjusted to suit the space between the rails.

For this purpose, the invention provides an assembly having a pair of rail-engageable members to be secured to the rails, the assembly being constructed so that the members may be moved one with respect to the other to suit the particular distance between the rails; these members being connected to a post having a jib at its upper end provided with a hoisting device such as a pulley block or a simple pulley if the motor weight is light.

Still another object of the invention is to provide a hoisting assembly that can be adjusted to be mounted on the railing of any boat and can be used for lifting other types of loads from a small dinghy into the boat.

In its broadest scope, therefore, the invention is a load-hoisting assembly for mounting on a pair of horizontal rails spaced apart a predetermined vertical distance, the assembly comprising an upright post having a jib at its upper end provided with a hoisting device. The assembly also comprises an upper rail-engageable member to be secured to the upper one of the rails and a lower rail-engageable member to be secured to the lower rail. According to the invention, connection means join these two members to the post and are so constructed as to allow relative displacement of the two members to suit the particular distance between the two rails.

According to a preferred embodiment, such connection means comprise:

a sleeve in which the post is slidably inserted and means for fixing said post to said sleeve selectively at one of a plurality of locations along said post;

a first connection arm solid at one end with one of the rail-engageable members and means for fixing said first arm to said sleeve at any selected location along said sleeve; and a second connection arm solid at one end with the other one of the rail-engageable members and means for fixing said second arm to said sleeve, whereby at least one of said first arm with the one member connected thereto, or of said second arm with the other member connected thereto may be moved along said sleeve with respect to the other to suit the predetermined distance between the rails.

In the particular case of an assembly for hoisting and storing an outboard motor on the upper and the lower horizontal rails of a boat railing, where the rails are spaced apart a predetermined distance, the assembly comprises:

an elongated post having, at the upper end thereof, an outwardly turned hoisting jib provided, at the free thereof, with a hoisting device;

a sleeve in which the post is telescopically mounted and means for fixing said post to said sleeve selectively at one of a plurality locations along said post;

a flat member for supporting and storing an outboard motor and a flat stabilizing member, each of said members including a pair of flat elements formed to define, when flatly applied against one another and clamped together, a through passage of a size suitable for mating with and be clamped over the horizontal rails, respectively;

means for so clamping said members on said rails;

an upright extension projecting from said supporting and storing member above said passage for supporting and storing an outboard motor; supporting and storing member and means for fixing said first arm at any selective location along said sleeve;

a second connection arm solid at the ends thereof respectively with said stabilizing member and means for fixing said second arm to said sleeve;

whereby, in use, at least one of said first arm together with the supporting and storing member connected thereto and of said second arm together with the stabilizing member connected thereto may be moved along the sleeve relative to each other to suit the predetermined distance between the rails.

Apart from U.S. Pat. No. 3,943,585, cited above, a prior art search has revealed the following other U.S. patents which do not disclose the novel features mentioned above. These other U.S. patents are as follows:

U.S. Pat. No. 2,486,094 of 1949;

U.S. Pat. No. 3,065,475 of 1962;

U.S. Pat. No. 4,526,126 of 1985.

A non-restrictive description now follows of a preferred embodiment of the invention, made with reference to the appended drawings.

DESCRIPTION OF A PREFERRED EMBODIMENT

Figure 1:
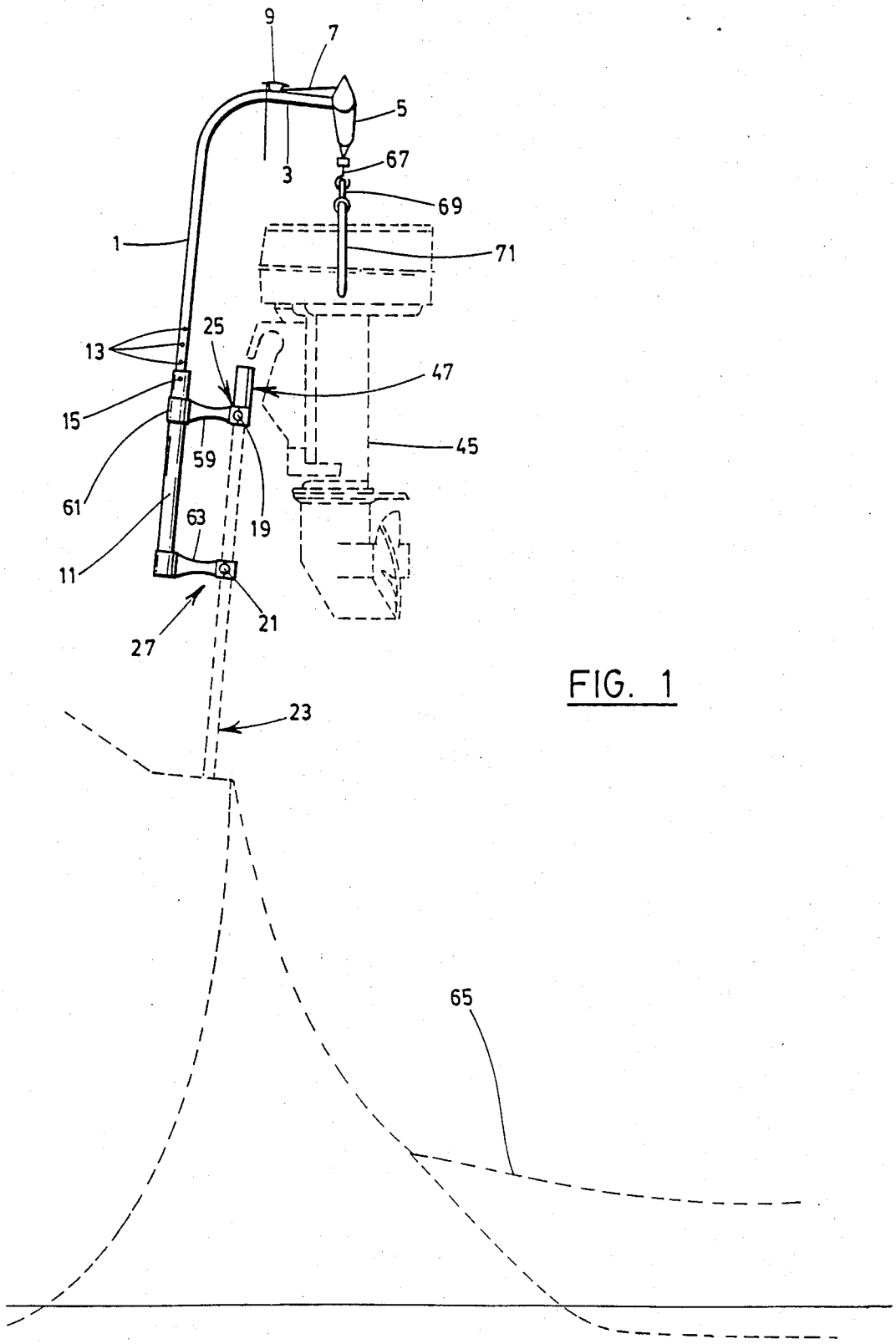
FIG. 1 is a cross-section view of the stern portion of a boat on the railing of which is mounted an outboard motor hoisting assembly made accordingly to the invention.

The outboard motor hoisting and storing assembly according to the invention as shown in the accompanying drawings comprises an upright elongated tubular metallic post 1 turning outwardly at its upper end to form a jib 3 provided with a hoisting device 5 in the form of a standard small pulley tackle. Should the load be light, a simple pulley may of course be found sufficient. The free end of the hoisting cable 7 is shown belayed about a cleat 9 which is preferably located on top of the jib 3.

The post 1 is telescopically or slidably mounted in a hollow cylindrical metallic sleeve 11. Equally spaced along the lower end of the vertical portion of the post 1 are through holes 13, each hole determining a particular location for the positioning of the post 1 in the sleeve 11. The latter has a single pair of coaxial holes 15 capable of registering, by telescoping the post along the sleeve, with any desired one of the post holes 13. When so registering, a pin 17 is inserted through the registering holes to hold the post 1 in position on the sleeve 11. With such means, it is thus possible to fix the post selectively at one of a plurality of locations along the sleeve.

Figure 3:
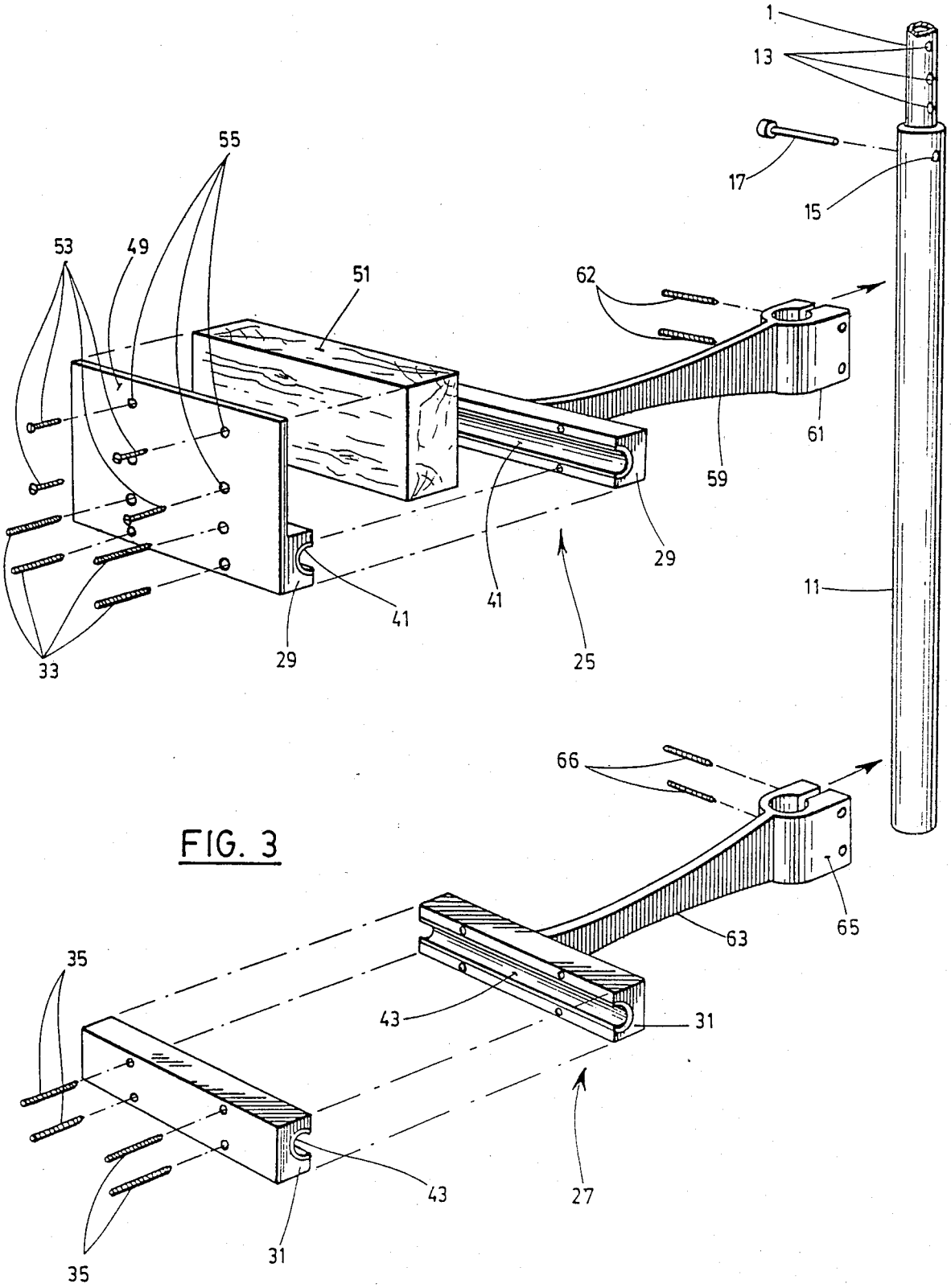
FIG. 3 is an exploded perspective view, on an enlarged scale, of the structure showing the motor supporting and storing member and the stabilizing member attached to the post.

The assembly is secured to the rails 19 and 21 of the railing 23 by an upper and a lower rail-engageable members 25 and 27, respectively. Each of the members 25, 27 as best shown in FIG. 3, are essentially made of a pair of flat elements 29, 31, formed to define, when they are flatly applied against one another and clamped by screws 33, 35, through cylindrical passages having a diameter suitable for mating with and be clamped over the horizontal rails 19, 21, respectively. The surface of each portion of the elements 29, 31 that comes into contact with a rail is preferably coated with a layer 41, 43, of neoprene and is in the shape of an arcuate segment slightly smaller than half the periphery of the rail so as to be firmly clamped against the same.

The upper member 25, which is intended to support and store the outboard motor 45, is provided for that purpose with an upright flat extension 47 (FIG. 3) upwardly projecting from the outermost element 29. As detailed in FIG. 3, the flat extension 47 is constituted by two cooperating flat plank-like parts 49, 51 having together the same width as the pair of elements 29 when both of them are clamped over the upper rail 19. The part 49 which is made of metal, preferably cast aluminum, integrally projects from the outer upper edge of the outermost element 29 (i.e. the one which is the farthest from the sleeve 11). The other part 51 is made of a solid piece of teak wood that is rigidly connected to the metal part 49 by means of screws 53 passing through holes 55 provided in the part 49.

The upper rail-engageable member 25 is connected to the sleeve 11 by a first horizontal metal arm 59 made solid at one end, in any known manner, with the innermost element 29, i.e. the nearest one from the sleeve 11. The arm 59 is formed, at the other end, with a hub 61 slidable on the sleeve 11. The hub 61 can be held fixed to the sleeve 11, in any selected position therealong, by conventional allen screws 62 threaded through appropriate topped holes of the hub.

The lower rail-engageable member 27, which is a stabilizing member, is connected to the sleeve 11 by a second horizontal arm 63 which is solid, in any known manner, with the nearest one of the flat element 31. This arm 63 can be made solid with the sleeve 11. However, the arm 63 is preferably formed at the other end with a hub 65 slidable on the sleeve 11 and fixable thereto in any protected position therealong by conventional allen screws 66 threaded through appropriate topped holes in the hub (see FIG. 3).

Thus, in this shown embodiment, the sleeve 11 and the arms 59, 63, constitute connection means joining the rail-engageable members 25, 27, to the jib post 1. In use, either one of the hubs 61 and 65 is loosened and the corresponding arm 59 or 63 moved with respect to the other arm until the cylindrical passages defined by members 29, 31 are spaced apart the same distance then that separating the two rails 19, 21. The hub 61 or 65 can then be clamped on the sleeve 11 and the members 25, 27, solidly fixed to the rails 19, 21. If necessary, the height of the pulley tackle 5 may be changed by sliding the post in the sleeve 11 and secured them together with the pin 17 when the proper height is obtained.

With the above arrangement, the assembly can easily be mounted on two rails of a boat railing regardless of the spacing between the rails. Also, once the tender 65 (FIG. 1) is brought close to the side of the boat and its motor 45 detached, the latter can easily be lifted by engaging a hook 67 provided at the end of the pulley cable 7 with an eye 69 provided on top of a hoisting attachment device 71 fixed to the motor. There is no longer any appreciable manual effort to be exerted and, more important so, the risk of accident is likewise considerably reduced. Furthermore, the operation can be carried out by a single person.

Figure 2:
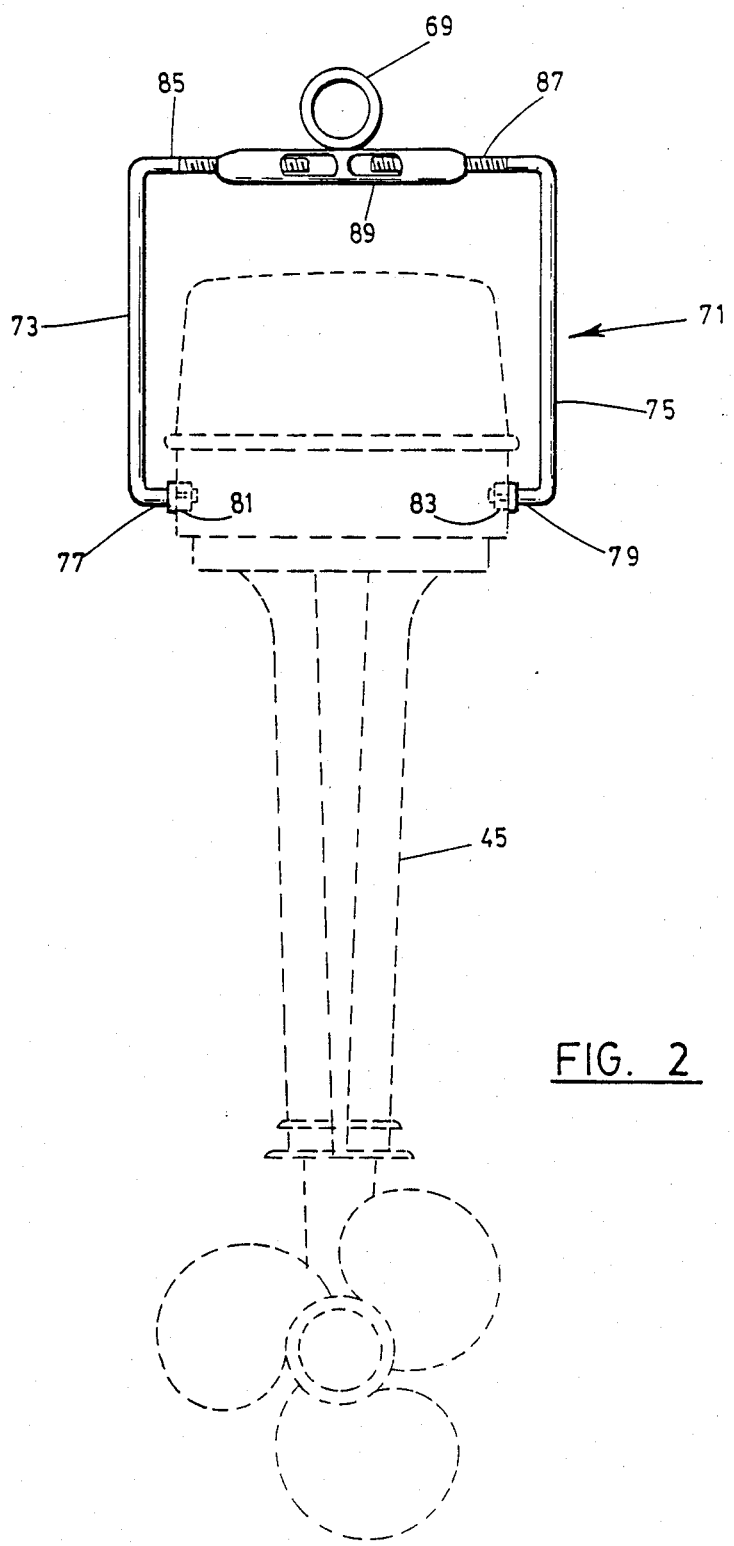
FIG. 2 is a rear elevation view of the gripping device intended to be connected to the motor to hoist it with the hoisting assembly.

As shown in FIG. 2, the attachment device 71 used to hoist the motor 45 preferably comprise two C-shaped arms 73, 75 whose lower ends 77, 79 are inserted into a pair of horizontally aligned sockets 81, 83 provided in the body or frame of the motor. The upper ends 85, 87 of the arms 73, 75 are both threaded in an inverted manner and threadly engaged into opposite threaded ends of a tubular socket 89 from which the eye 69 projects.

As can be understood, mere rotation of the socket 89 in one given direction is sufficient to cause the threaded ends 85 and 87 of the arms 73 and 75 to move toward each other and thus rigidly and safely "pinch" the motor 45 between the ends 77 and 79. Of course, rotation of the socket in the other direction makes it possible to detach the arms 73 and 75 from the motor 45.

It will be appreciated by those skilled in the art, that the same advantage could be obtained if the hub 61 of the rail-engaging upper member 25 were made to telescope directly onto the post 1 and the rail-engaging lower member 27 connected to the post 1.

I claim:

1. An assembly for hoisting and storing an outboard motor on an upper and on a lower horizontal rail of a boat railing, said rails being spaced apart a predetermined distance; within said assembly comprises:

an elongated post having, at the upper end thereof, an outwardly turned hoisting jib provided, at the free end thereof, with a hoisting device;

a sleeve in which the post is telescopically mounted on said post and means for fixing said post to said sleeve selectively at one of a plurality locations along said post;

a flat member for supporting and storing an outboard motor and a flat stabilizing member each of said members including a pair of flat elements formed to define, when flatly applied against one another and clamped together, a through passage of a size suitable for mating with and be clamped over said horizontal rails, respectively;

means for so clamping said members on said rails;

an upright extension projecting from said supporting and storing member above said passage for supporting and storing an outboard motor;

a first connection arm solid at one end with said supporting and storing member and means for fixing said first arm at any selective location along said sleeve;

a second connection arm solid at the ends thereof respectively with said stabilizing member and means for fixing said second arm to said sleeve;

whereby, in use, at least one of said first and second arms may be moved along said sleeve relative to each other to suit said predetermined distance.

2. An assembly as claimed in claim 1, wherein said first and second arms are horizontal arms and join said members and said sleeve at right angle.

3. An assembly as claimed in claim 2, wherein said hoisting device is a pulley tackle.

4. An assembly as claimed in claim 1, wherein said first connection arm extends at one end perpendicularly from one of said flat elements of said supporting and storing member and includes a first hub at the other end constructed to slide along said sleeve.

5. An assembly as claimed in claim 4, wherein said means for fixing said first arm to said sleeve are allen screw means extending through said first hub.

6. An assembly as claimed in claim 4, wherein said second connection arm extends at one end perpendicularly from one of said flat elements of said stabilizing member and includes a second hub at the other end constructed to slide along said sleeve.

7. An assembly as claimed in claim 1, wherein the hoisting device comprises a pulley tackle on which a pulley cable is wound and wherein said assembly further comprises a motor attachment device connected to the pulley cable, said attachment device comprising a pair of C-shaped arms having lower ends engageable into aligned sockets provided in the motor and upper ends each provided with an inverted thread, and a tubular socket having opposite threaded ends in which the upper ends of the C-shaped arms are threaded.

8. An assembly as claimed in claim 6, wherein the hoisting device comprises a pulley tackle on which a pulley cable is wound and within said assembly further comprises a motor attachment device connected to the pulley cable, said attachment device comprising a pair of C-shaped arms having lower ends engageable into aligned sockets provided in the motor and upper ends each provided with an inverted thread, and a tubular socket having opposite threaded ends in which the upper ends of the C-shaped arms are threaded.

* * * * *